US005829414A

United States Patent [19]

Tsunoda et al.

[11] Patent Number: 5,829,414

[45] Date of Patent: Nov. 3, 1998

[54] FUEL SUPPLY SYSTEM FOR MULTI-CYLINDER ENGINE

[75] Inventors: Masaki Tsunoda; Mitsuharu Tanaka, both of Wako, Japan

[73] Assignee: Honda Giken Kogyo Kabushiki Kaisha, Tokyo, Japan

[21] Appl. No.: 532,459

[22] Filed: Sep. 22, 1995

[30] Foreign Application Priority Data

Sep. 26, 1994 [JP] Japan ..... 6-230072
Sep. 26, 1994 [JP] Japan ..... 6-230074

[51] Int. Cl.[6] ..... F02M 41/00

[52] U.S. Cl. ..... 123/508; 123/509

[58] Field of Search ..... 123/508, 509, 123/54.4, 456, 90.21

[56] References Cited

U.S. PATENT DOCUMENTS

| | | | |
|---|---|---|---|
| 4,412,513 | 11/1983 | Obermayer | 123/54.4 |
| 4,602,604 | 7/1986 | Kauer | 123/508 |
| 4,721,075 | 1/1988 | Kasai | 123/508 |
| 4,836,171 | 6/1989 | Melde-Tuczai | 123/508 |
| 5,083,544 | 1/1992 | Brighigna | 123/508 |
| 5,507,261 | 4/1996 | Johnson | 123/508 |
| 5,553,592 | 9/1996 | Bauerle | 123/456 |
| 5,564,395 | 10/1996 | Moser | 123/509 |

FOREIGN PATENT DOCUMENTS

| | | |
|---|---|---|
| 104668 | of 0000 | Japan . |
| 63-104668 | 7/1988 | Japan . |
| 3-73660 | 7/1991 | Japan . |

*Primary Examiner*—Carl S. Miller
*Attorney, Agent, or Firm*—Nikaido Marmelstein Murray & Oram, LLP

[57] ABSTRACT

In a fuel supply system for a multi-cylinder engine, a pump driving cam is provided between an intake cam and an exhaust cam on a camshaft. The pump driving cam and a fuel pump are interconnected by a pump driving member. The pump driving member is slidably supported on a pair of supporting portions which are projectingly, integrally provided on a cylinder head and disposed between valve springs of a pair of intake valves. Thus, the intake valves and the valve springs are prevented from interfering with the pump driving member and the supporting portions and therefore, the fuel pump driven by the camshaft in the multi-cylinder engine can be disposed at a lengthwise intermediate portion of the camshaft. As a result, the distance between the fuel pump and each of the carburetors can be decreased to enable a stable supply of fuel.

10 Claims, 8 Drawing Sheets

FUEL SUPPLY SYSTEM FOR MULTI-CYLINDER ENGINE

BACKGROUND OF THE INVENTION

1. Field of the Invention

The present invention relates to a fuel supply system for a multi-cylinder engine for supplying fuel from a fuel pump to carburetors provided respectively in a plurality of cylinders.

2. Description of the Prior Art

Fuel supply systems including a fuel pump driven by a pump driving cam provided on a camshaft in an engine are conventionally known from Japanese Utility Model Application Laid-open Nos. 73660/91, 104668/88 and 119562/91.

In any of the above known systems, the fuel pump is mounted in the vicinity of an end of the camshaft. For this reason, there is a possibility that when the engine is disposed vertically and the fuel pump is disposed in the vicinity of a lower end of the camshaft, it is necessary to set the capability of the fuel pump at a high level, so that fuel can be reliably supplied to a carburetor for a cylinder which is disposed at the highest location so as to keep a high level of fuel within a float chamber. As a result, the size of the fuel pump is increased, which causes a reduction in a degree of freedom in laying out an engine room and which causes an increase in cost.

SUMMARY OF THE INVENTION

Accordingly, it is an object of the present invention to provide a fuel supply system designed so that fuel can be reliably supplied to a plurality of carburetors mounted in a multi-cylinder engine without using a fuel pump having a large capability.

To achieve the above object, according to the first embodiment of the present invention, there is provided a fuel supply system for a multi-cylinder engine for supplying fuel from a fuel pump, driven by a camshaft, to a carburetor mounted for each of a plurality of cylinders. The fuel supply system comprises a pump driving member which is disposed between valve springs of two intake valves mounted to correspond to each of the cylinders. The pump driving member connects the fuel pump with a pump driving cam provided on the camshaft.

With the above construction, the interference of the valve springs and the pump driving member can be avoided. Thus, the fuel pump can be mounted at a lengthwise intermediate portion of the camshaft, leading not only to an increased degree of freedom in layout of the engine room, but also to a decreased distance between the fuel pump and each of the carburetors to enable a stable supply of fuel.

If a pair of supporting portions are provided on opposite sides of a straight line connecting the two intake valves so as to project from a cylinder head and the pump driving member is slidably supported on the supporting portions, it is possible to prevent interference of the supporting portions, of the pump driving member, with the valve springs.

In addition, if the pump driving member is swingably supported on an intake rocker arm shaft, on which an intake rocker arm for driving the intake valves is pivotally supported, it is unnecessary to provide the supporting portion for the pump driving member, thereby enabling a degree of freedom in layout of the intake valves and the valve springs.

Further, to achieve the above object, according to the second embodiment of the present invention, there is provided a fuel supply system for a multi-cylinder engine for supplying fuel from a fuel pump to a carburetor mounted for each of a plurality of cylinders, wherein the cylinders are divided into a plurality of cylinder groups, and the fuel pumps are mounted in correspondence to each of the cylinder groups. The fuel supply system further includes a camshaft provided in common for the plurality of cylinders. A plurality of pump driving cams are provided on the camshaft for driving the fuel pumps.

With the above construction, the distance between each of the fuel pumps and the corresponding carburetor can be decreased, thereby reducing the capability required for each of the fuel pump. Thus, the use of an inexpensive fuel pump having a relatively small capability and a small size enables fuel to be reliably supplied to the carburetor. Moreover, the plurality of fuel pumps can be arranged in a compact manner along one side of the engine.

Yet further, to achieve the above object, according to a third embodiment of the present invention, there is provided a fuel supply system for a multi-cylinder engine for supplying fuel from a fuel pump to a carburetor mounted for each of a plurality of cylinders. The cylinders are divided into a plurality of cylinder groups along a direction of an array of the cylinders. The fuel pump is provided for each of the cylinder groups within a range of an array of the cylinders of respective cylinder groups.

With the above construction, the distance between each of the fuel pumps and the corresponding carburetor can be decreased, thereby reducing the capability required for each of the fuel pumps. Thus, the use of an inexpensive fuel pump having a relatively small capability and a small size enables fuel to be reliably supplied to the carburetor. Moreover, since the number of the fuel pumps corresponding to each of the cylinder groups are disposed within a range of arrangement of the cylinders in each of the cylinder groups, the difference of altitude between the fuel pump and the carburetor can be further decreased.

The above and other objects, features and advantages of the invention will become apparent from the following description of the preferred embodiments taken in conjunction with the accompanying drawings.

DESCRIPTION OF THE PREFERRED EMBODIMENTS

A first embodiment of the present invention will now be described with reference to FIGS. 1 to 5.

Figure 1:
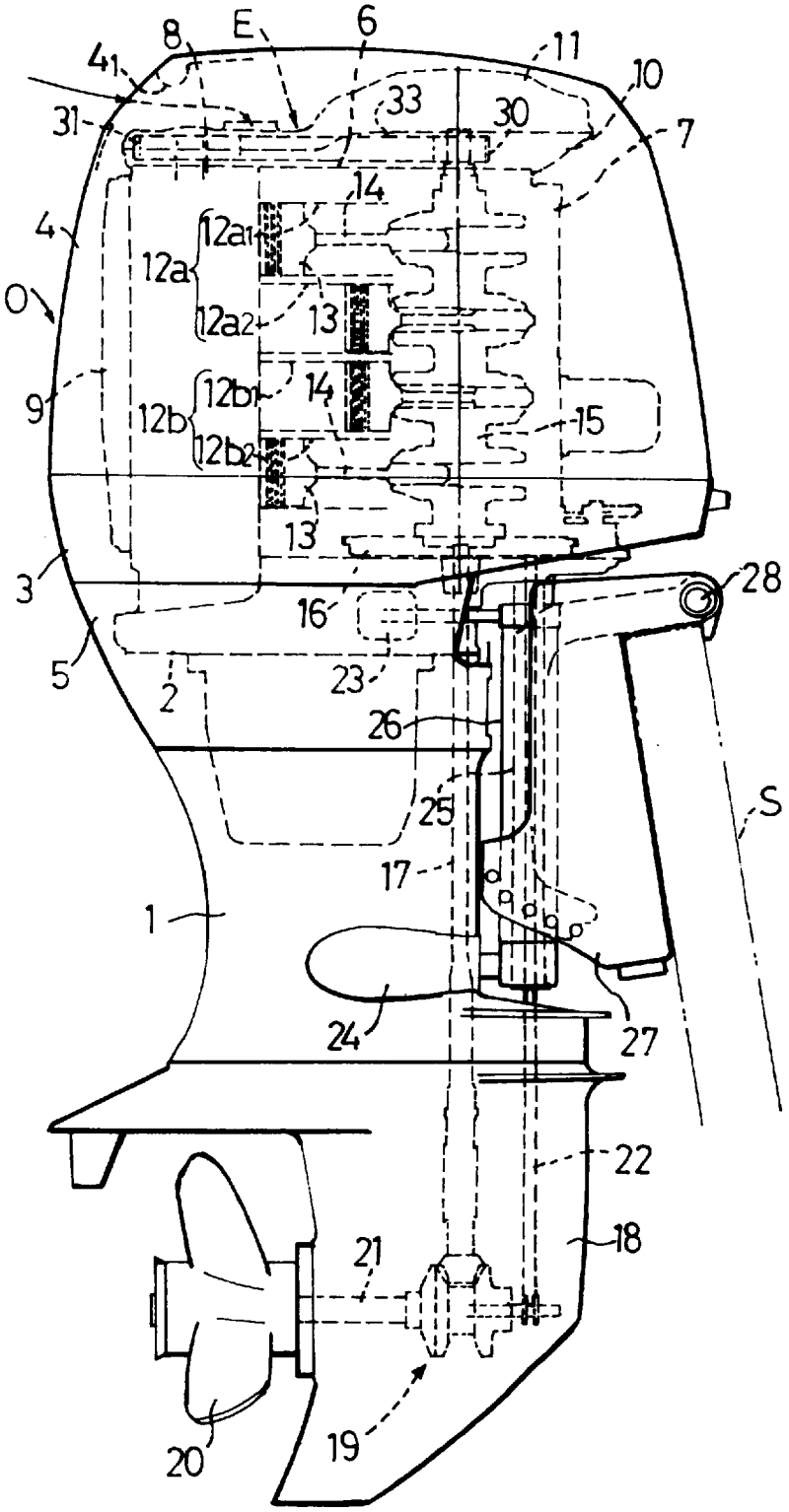
FIG. 1 is a side view of the entire outboard engine system incorporating a fuel supply system according to a first embodiment of the present invention.

Referring to FIG. 1, an outboard engine system O includes a mount case 2 coupled to an upper portion of an extension case 1. An inline type 4-cylinder and 4-cycle engine E is supported on an upper surface of the mount case 2. An under-case 3 having an open upper surface is coupled to the mount case 2. An engine cover 4 is detachably mounted on an upper portion of the under-case 3. An under-cover 5 is mounted between a lower edge of the under-case 3 and an upper edge of the extension case 1 to cover an outside of the mount case 2.

The engine E includes a cylinder block 6, a crankcase 7, a cylinder head 8, a head cover 9, a lower belt cover 10 and an upper belt cover 11. The cylinder block 6 and the crankcase 7 are supported on the upper surface of the mount case 2. Pistons 13 are slidably received in four cylinders $\mathbf{12}a_1$, $\mathbf{12}a_2$, $\mathbf{12}b_1$, and $\mathbf{12}b_2$ defined in the cylinder block 6, respectively. The pistons 13 are connected to a vertically disposed crankshaft 15 through connecting rods 14, respectively. The upper two cylinders $\mathbf{12}a_1$, and $\mathbf{12}a_2$ constitute a first cylinder group 12*a*, while the lower two cylinders $\mathbf{12}b_1$ and $\mathbf{12}b_2$ constitute a second cylinder group 12*b*. The cylinder block 6 and the crankcase 7 constitute an engine body.

A driving shaft 17 is connected to a lower end of the crankshaft 15 along with a flywheel 16. The driving shaft 17 extends downwardly within the extension case 1. A lower end of the driving shaft 18 is connected through a bevel gear mechanism 19 to a propeller shaft 21 having a propeller 20 at its rear end. A shift rod 22 is connected at its lower end to a front portion of the bevel gear mechanism 19 in order to change the direction of rotation of the propeller shaft 21.

A swivel shaft 25 is fixed between an upper mount 23 provided in the mount case 2 and a lower mount 24 provided in the extension case 1. A swivel case 26, for rotatably supporting the swivel shaft 25, is vertically swingably supported on a stern bracket 27 mounted at a stern S through a tilting shaft 28.

A single camshaft 29 (see FIG. 4) parallel to the crankshaft 15 is rotatably supported on the cylinder head 8. A timing belt 33 is reeved over a crank pulley 30 mounted at an upper end of the crankshaft 15. A cam pulley 31 is mounted at an upper end of the camshaft 29. The cam pulley 31 and the timing belt 33 are accommodated within the lower belt cover 10 and the upper belt cover 11.

Figure 3:
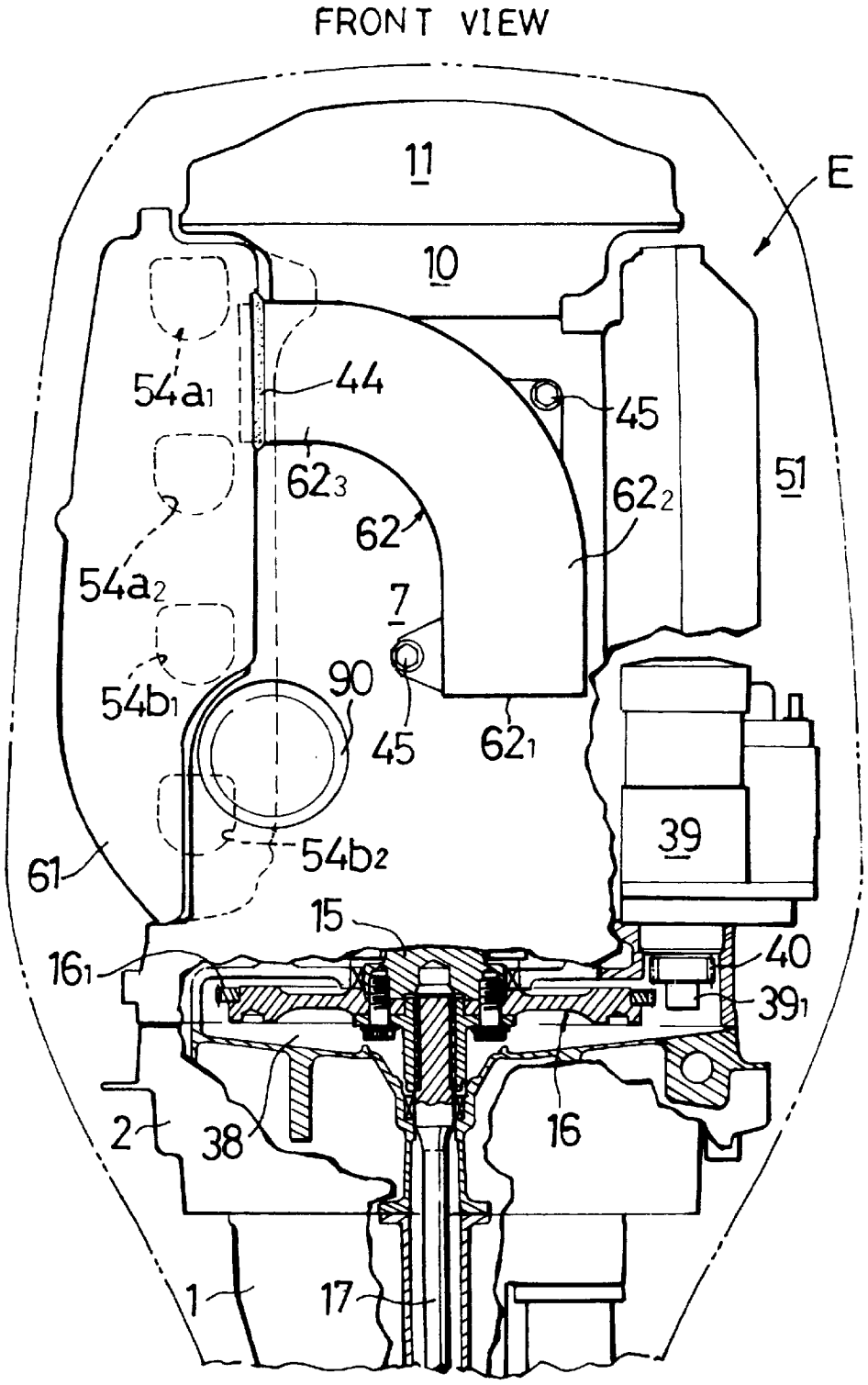
FIG. 3 is a view taken in a direction of an arrow 3 in FIG. 2.

As can be seen also from FIG. 3, the flywheel 16 is accommodated in a flywheel accommodating chamber 38 which is defined by the cylinder block 6, the crankcase 7 and the mount case 2. A plunging-type pinion 40 is provided on an output shaft $\mathbf{39}_1$ of a stator motor 39 and meshed with a gear $\mathbf{16}_1$ formed around an outer periphery of the flywheel 16.

The structure of an intake system in the engine E will be described below with reference to FIGS. 2 and 3.

An intake manifold 53 is coupled to a right side of the cylinder head 8 of the engine E accommodated in an engine room 51 defined within the engine cover 4. The intake manifold 53 has four intake passages 52 provided therein in correspondence to the four cylinders $\mathbf{12}a_1$, $\mathbf{12}a_2$, $\mathbf{12}b_1$, and $\mathbf{12}b_2$, respectively. Each of the intake passages 52 is curved forwardly, and four carburetors $\mathbf{54}a_1$, $\mathbf{54}a_2$, $\mathbf{54}b_1$, and $\mathbf{54}b_2$ are connected to front ends of the intake passages 52, respectively.

A throttle valve and a choke valve (both not shown) are accommodated in each of the carburetors $\mathbf{54}a_1$, $\mathbf{54}a_2$, $\mathbf{54}b_1$, and $\mathbf{54}b_2$, so that throttle valve levers 56, coupled to valve stems 55 of the throttle valves, are driven in operative association with one another by a common link 57. Choke valve levers 59 coupled to valve stems 58 of the choke valves are driven in operative association with one another by a common link 60.

Upstream ends of the carburetors $\mathbf{54}a_1$, $\mathbf{54}a_2$, $\mathbf{54}b_1$, and $\mathbf{54}b_2$ are connected to a porous-type first intake silencing chamber 61 which is disposed along a right side of the crankcase 7 of the engine E. The first intake silencing chamber 61 is comprised of a base plate $\mathbf{61}_1$ which supports the carburetors $\mathbf{54}a_1$, $\mathbf{54}a_2$, $\mathbf{54}b_1$, and $\mathbf{54}b_2$ and air horns 41, and a main body $\mathbf{61}_2$ which defines a silencing space by cooperation with the base plate $\mathbf{61}_1$. The air horns 41 extend within the first intake silencing chamber 61 and have meshes 42 provided at their tip ends. A drain pipe 43 is mounted at a lower end of the first intake silencing chamber 61 for discharging oil accumulated in the first intake silencing chamber 61. The first intake silencing chamber 61 provided at the crankcase 7 of the engine E and receiving a large vibration, and the second intake silencing chamber located away from the engine E and receiving a smaller vibration can flexibly be connected with each other through the grommet 44.

A duct-type second intake silencing chamber 62, which is connected to an upstream side of the first intake silencing chamber 61, is coupled through a grommet 44 to a space defined along an opposite side of the crankcase 7 from the cylinder head 8, i.e., a front space in the engine room 51, and is fixed to a front surface of the crankcase 7 by two bolts 45, 45. The second intake silencing chamber 62 includes a first portion $\mathbf{62}_2$ extending upwardly from an intake bore $\mathbf{62}_1$ which opens downwardly, and a second portion $\mathbf{62}_3$ which is curved horizontally through 90° from the first portion $\mathbf{62}_2$ and connected to a left side of an upper portion of the first intake silencing chamber 61.

Figure 2:
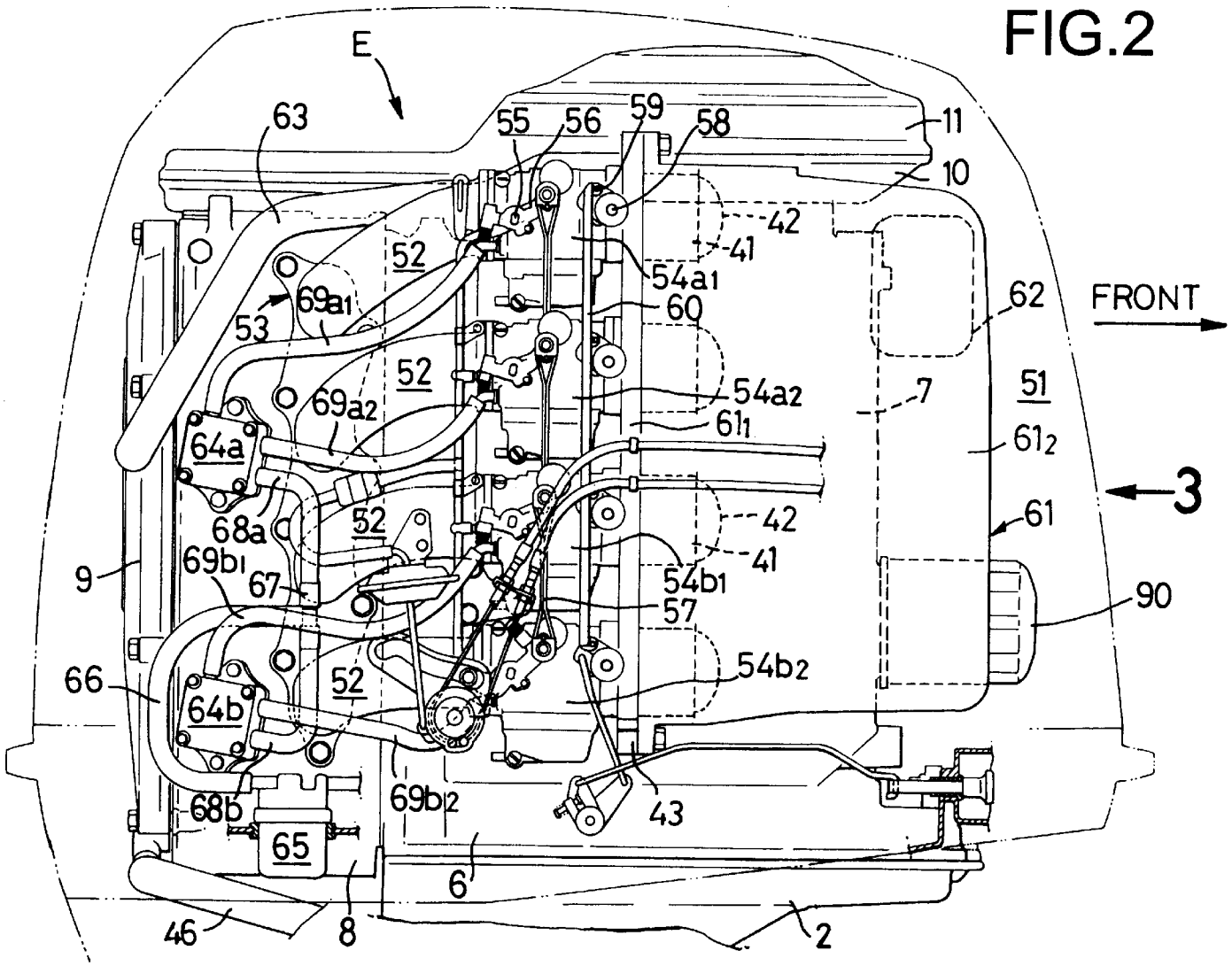
FIG. 2 is an enlarged view of an essential portion shown in FIG. 1.

In FIG. 2, reference numeral 63 is a breather pipe which interconnects the head cover 9 and the first intake silencing chamber 61, and reference numeral 46 is an oil return hose.

Further, in the drawings, reference numeral 90 is an oil filter, reference numeral 91 is an exhaust passage, and reference number 92 is a head clamping bolt.

As described above, the first intake silencing chamber 61 is disposed utilizing the space defined along the right side of the crankcase 7, and the second intake silencing chamber 62 is disposed utilizing the space defined along the front surface of the crankcase 7. Therefore, it is possible to insure a sufficient total volume of the intake silencing chambers 61 and 62 to effectively prevent intake noise. Moreover, it is possible not only to insure a large volume within the limited space, because the second intake silencing chamber 62 includes not only the first portion $\mathbf{62}_2$ and the second portion $\mathbf{62}_3$ curved through 90°, but also it is possible to reliably prevent water from entering the intake system, because the intake bore $\mathbf{62}_1$ opens downwardly.

In addition, since the second intake silencing chamber 62 is provided to enhance the silencing effect, a porous member accommodated within the first intake silencing chamber 61 can be changed, reduced in size, or omitted. Moreover, the first intake silencing chamber 61 is defined to largely project forwardly in order to connect the second intake silencing chamber 62 and therefore, the length of the air horns 41 accommodated within the first intake silencing chamber 61 can be set at a large value. Thus, it is possible not only to improve the silencing characteristic as desired, but also to facilitate the catching of blown-back air from the carburetors $\mathbf{54}a_1$, $\mathbf{54}a_2$, $\mathbf{54}b_1$, and $\mathbf{54}b_2$ by the air horns 41. Further, since the first and second intake silencing chambers 61 and 62 are disposed perpendicular to each other, the blown-back air from the carburetors 54$a_1$, 54$a_2$, 54$b_1$, and 54$b_2$ can be accumulated in the first intake silencing chamber 61.

The structure of a fuel supplying system of the engine E will be described below with reference to FIG. 2.

A first fuel pump 64*a* and a second fuel pump 64*b* are mounted on the right side of the cylinder head 8 of the engine E, and a fuel tank (not shown) is connected to intake ports of the two fuel pumps 64*a* and 64*b* through a fuel filter 65, a fuel supply pipe 66, a joint 67 and fuel supply pipes 68*a* and 68*b*.

A discharge port of the upper first fuel pump 64*a* is connected to the carburetors 54$a_1$ and 54$a_2$ for the two cylinders 12$a_1$ and 12$a_2$ of the upper first cylinder group 12*a* through fuel supply pipes 69$a_1$ and 69$a_2$, while a discharge port of the lower second fuel pump 64*b* is connected to the carburetors 54$b_1$ and 54$b_2$ for the two cylinders 12$b_1$ and 12$b_2$ of the lower first cylinder group 12*b* through fuel supply pipes 69$b_1$ and 69$b_2$.

The first fuel pump 64*a* is mounted at a location slightly lower than the carburetor 54$a_2$ for the lower one cylinder 12$a_2$ of the two cylinders 12$a_1$ and 12$a_2$ of the first cylinder group 12*a* and therefore, the fuel supply pipes 69$a_1$ and 69$a_2$ extend upwardly from the first fuel pump 64*a* toward the two carburetors 54$a_1$ and 54$a_2$. The second fuel pump 64*b* is mounted at a location slightly lower than the carburetor 54$b_2$ for the lower one cylinder 12$b_2$ of the two cylinders 12$b_1$ and 12$b_2$ of the second cylinder group 12*b* and therefore, the fuel supply pipes 69$b_1$, and 69$b_2$ extend upwardly from the second fuel pump 64*b* toward the two carburetors 54$b_1$ and 54$b_2$.

Figure 4:
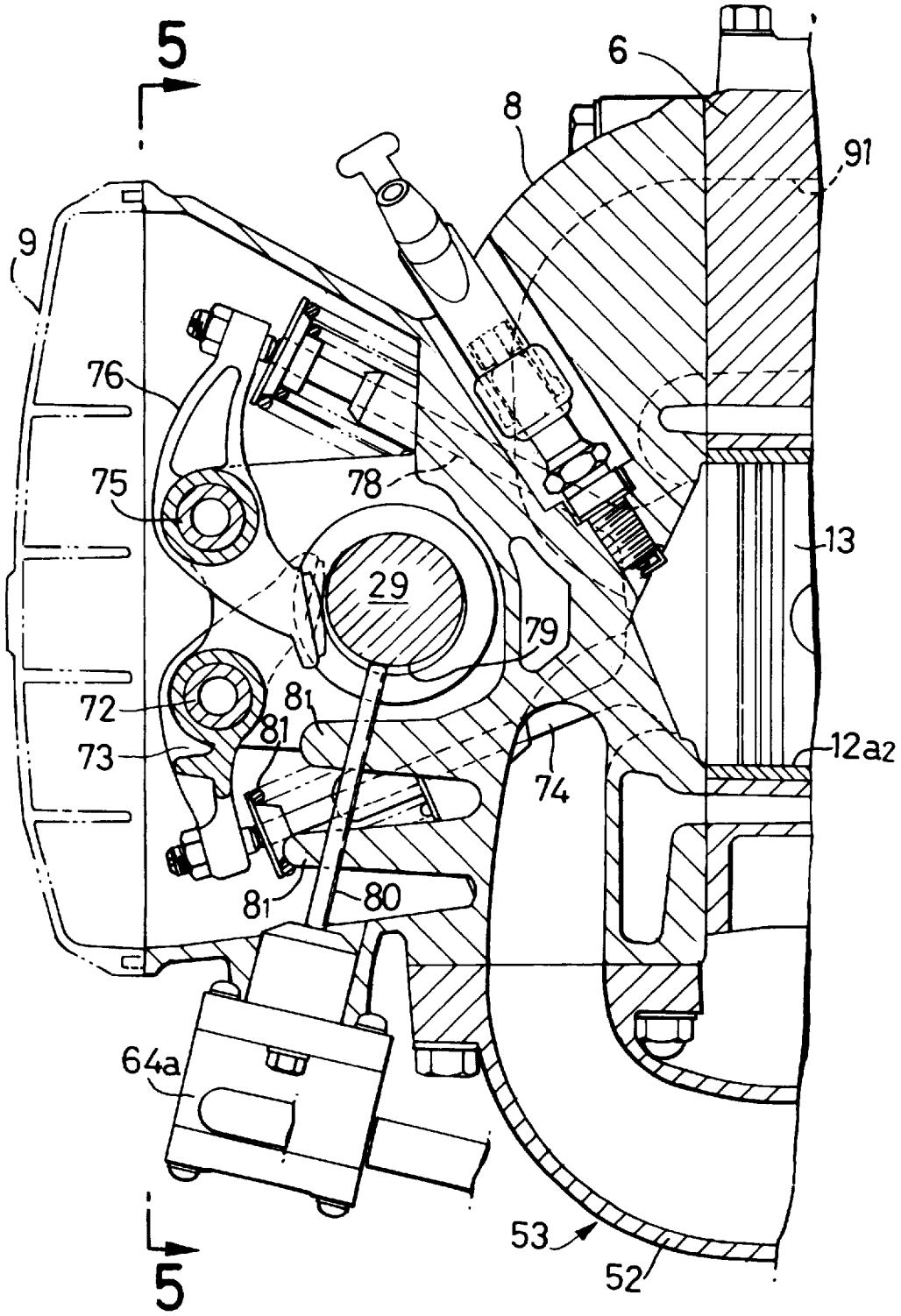
FIG. 4 is a sectional view of a cylinder head.
Figure 5:
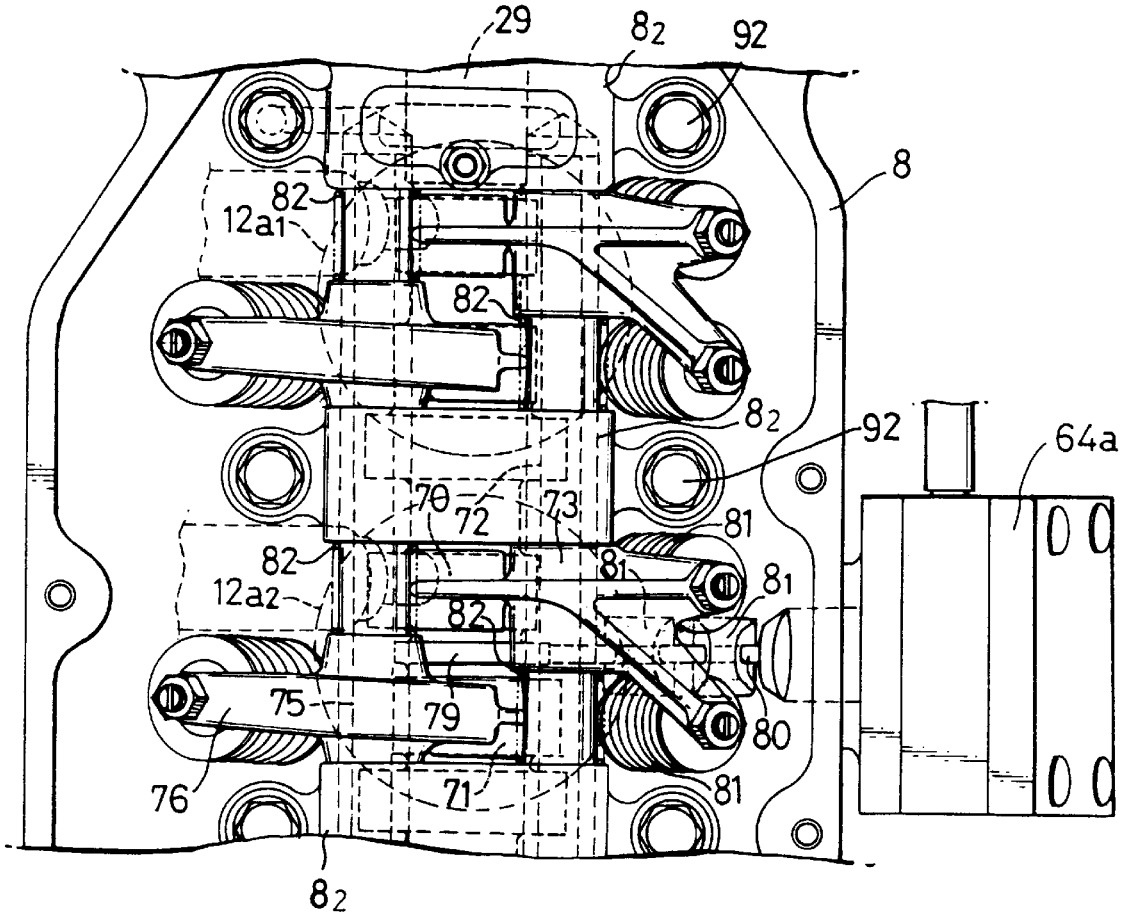
FIG. 5 is a sectional view taken along a line 5—5 in FIG. 4.

The structure of driving systems for the fuel pumps 64*a* and 64*b* will be described below with reference to FIGS.4 and 5. The driving systems for the fuel pumps 64*a* and 64*b* have the same structure and hence, the structure of the driving system for the first fuel pump 64*a* as a representative will be described.

Intake cams 70 and exhaust cams 71 are provided on the camshaft 29, supported in the cylinder head 8, to correspond to the cylinders 12$a_1$, 12$a_2$, 12$b_1$, and 12$b_2$. Intake rocker arms 73 are pivotally supported on an intake rocker arm shaft 72 to abut against the intake cam 70 and two intake valves 74 which are mounted for each of the cylinders 12$a_1$, 12$a_2$, 12$b_1$, and 12$b_2$. Exhaust rocker arms 76 are pivotally supported on an intake rocker arm shaft 72 to abut against the exhaust cams 71 and one exhaust valve 78 is mounted for each of the cylinders 12$a_1$, 12$a_2$, 12$b_1$, and 12$b_2$.

A pump driving cam 79 is provided between the intake cam 70 and the exhaust cam 71 for the cylinder 12$a_2$, and a pump driving member 80 is slidably supported on a pair of supporting portions 8$_1$, 8$_1$ formed on the cylinder head 8 to abut against the pump driving cam 79. The pump driving member 80 extends within the first fuel pump 64*a*, where it is connected to a plunger (not shown). Thus, the first fuel pump 64*a* can be driven through the pump driving cam 79 and the pump driving member 80 by the rotation of the camshaft 29.

The pump driving member 80 is disposed to pass between valve springs 81, 81 of the two intake valves 74, 74. Thus, the first fuel pump 64*a* can be driven, while avoiding interference of the pump driving member 80 with the valve springs 81, 81. Moreover, interference of the valve springs 81, 81 with the supporting portions 8$_1$, 8$_1$ can be avoided without an increase in distance between the intake valves 74, 74 by the provision of the pair of supporting portions 8$_1$, 8$_1$.

Because interference of the valve springs 81, 81 with the supporting portions 8$_1$, 8$_1$ has been avoided, the first and second fuel pumps 64*a* and 64*b* can be disposed at a lengthwise intermediate portion of the camshaft 29. As a result, the difference of altitude between the cylinder located at a higher level and the fuel pump can be decreased, compared with when the fuel pump is mounted at a lower end of the camshaft. Hence, even if fuel pumps 64*a* and 64*b* having a small size and a small capacity are used, fuel can be reliably supplied to the carburetors 54$a_1$, 54$a_2$, 54$b_1$, and 54$b_2$, and a uniform fuel level is maintained within a float chamber.

The operation of the embodiment of the present invention having the above-described construction will be described below.

When the camshaft 29 is rotated in operative association with the crankshaft 15 by the operation of the engine E, the pump driving members 80, 80 abutting against the two pump driving cams 79, 79 are reciprocally moved to drive the first and second fuel pumps 64*a* and 64*b*. This causes the fuel drawn from the fuel tank (not shown) through the fuel filter 65, the fuel supply pipe 66, the joint 67 and the fuel supply pipes 68*a* and 68*b* to be supplied to the carburetors 54$a_1$, and 54$a_2$ for the two cylinders 12$a_1$ and 12$a_2$ of the first cylinder group 12*a*, by way of the fuel supply pipes 69$a_1$ and 69$a_2$ connected to the first fuel pump 64*a*, and also to the carburetors 54$b_1$ and 54$b_2$ for the two cylinders 12$b_1$ and 12$b_2$ of the second cylinder group 12*b* by way of the fuel supply pipes 69$b_1$ and 69$b_2$ connected to the second fuel pump 64*b*.

Air is drawn through an air intake bore 4$_1$ defined in an upper portion of the engine cover 4, into the second intake silencing chamber 62 through its intake bore 62$_1$. The drawn air is then supplied through the first intake silencing chamber 61 to the carburetors 54$a_1$, 54$a_2$, 54$b_1$, and 54$b_2$, where the air and fuel are mixed. The resulting mixture is supplied through the intake passages 52 in the intake manifold 53 to the cylinders 12$a_1$, 12$a_2$, 12$b_1$, and 12$b_2$.

The first fuel pump 64*a* is provided for the two cylinders 12$a_1$ and 12$a_2$ of the first cylinder group 12*a*, and the second fuel pump 64*b* is provided for the two cylinders 12$b_1$ and 12$b_2$ of the second cylinder group 12*b*, as described above. Therefore, even if fuel pumps 64*a* and 64*b* having a small size and a small capacity are used, the fuel can be reliably supplied to the carburetors 54$a_1$, 54$a_2$, 54$b_1$ and 54$b_2$ which are located at a higher level. Moreover, the degree of freedom in layout within the narrow engine room 51 can be increased, as compared with when a single large-sized fuel pump is used.

In addition, since the first fuel pump 64*a* is mounted at a location slightly lower than the carburetor 54$a_2$ for a lower one cylinder 12$a_2$ of the two cylinders 12$a_1$ and 12$a_2$ of the first cylinder group 12*a*, the fuel supply pipes 69$a_1$ and 69$a_2$ can be extended upwardly from the first fuel pump 64*a* toward the two carburetors 54$a_1$ and 54$a_2$ to prevent the residence of fuel vapor. Likewise, since the second fuel pump 64*b* is mounted at a location slightly lower than the carburetor 54$b_2$ for the lower one cylinder 12$b_2$ of the two cylinders 12$b_1$ and 12$b_2$ of the second cylinder group 12*b*, the fuel supply pipes 69$b_1$ and 69$b_2$ can be extended upwardly from the second fuel pump 64*b* toward the two carburetors 54$b_1$ and 54$b_2$ to prevent the residence of fuel vapor.

Further, the first and second fuel pumps 64*a* and 64*b* are disposed along the sidewall of the cylinder head 8 and moreover, the first fuel pump 64*a* is disposed in a vicinity of the corresponding cylinder group 12*a*, while the second fuel pump 64*b* is disposed in a vicinity of the corresponding cylinder group 12*b*. Therefore, the difference of altitude between the first and second fuel pumps 64*a* and 64*b* and the cylinders $\mathbf{12}a_1$ and $\mathbf{12}b_1$ disposed at higher locations can be reduced to a minimum, and the length of the fuel supply pipes $\mathbf{69}a_1$, $\mathbf{69}a_2$, $\mathbf{69}b_1$, and $\mathbf{69}b_2$ can be reduced to a minimum.

Figure 6:
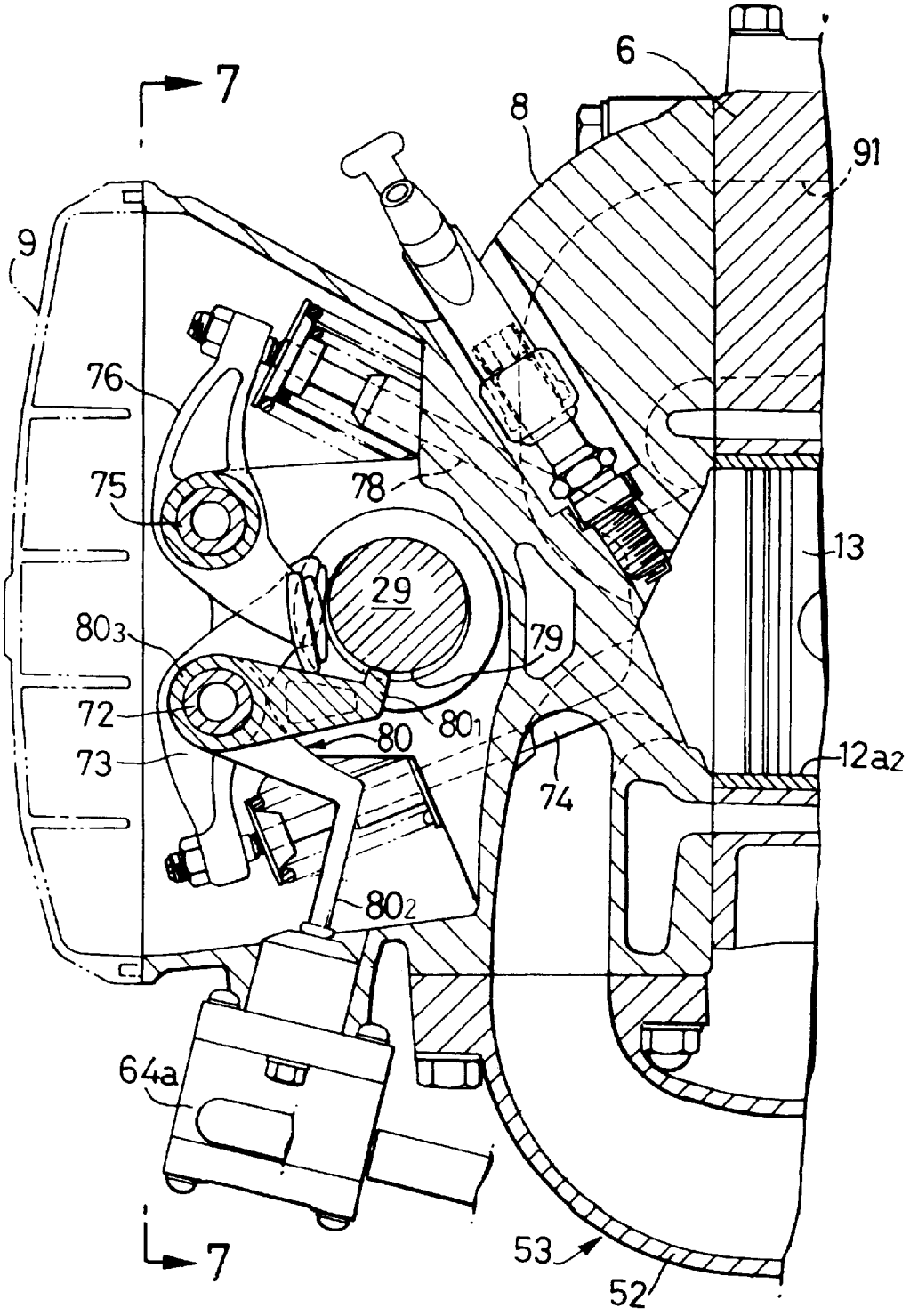
FIG. 6 is a view similar to FIG. 4, but illustrating a second embodiment of the present invention.
Figure 7:
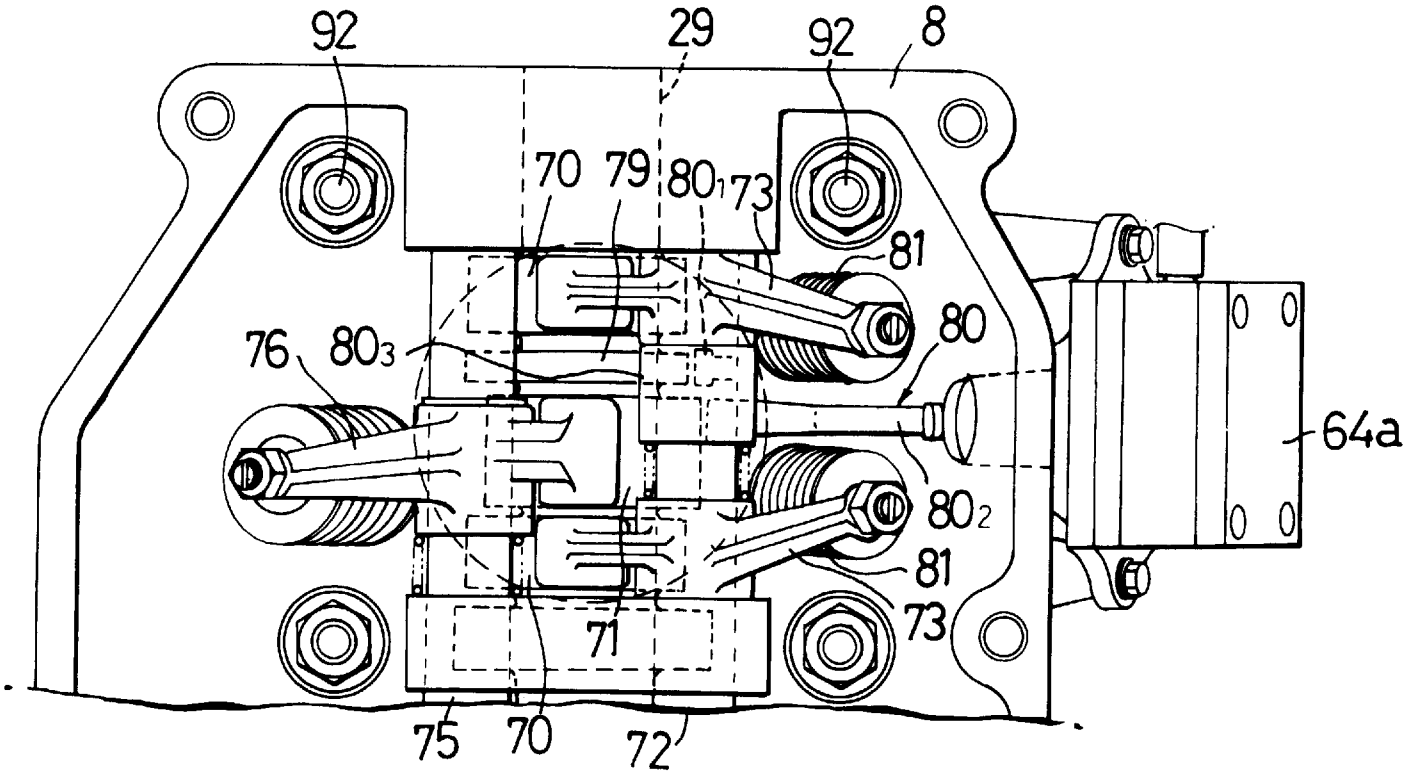
FIG. 7 is a sectional view taken along a line 7—7 in FIG. 6.

A second embodiment of the present invention will now be described with reference to FIGS.6 and 7.

In the second embodiment, two intake valves 74, 74 are mounted for each of the cylinders $\mathbf{12}a_1$, $\mathbf{12}a_2$, $\mathbf{12}b_1$, and $\mathbf{12}b_2$ and driven by two independent intake cams 70, 70 and two independent intake rocker arms 73, 73. The pump driving member 80 includes a first arm $\mathbf{80}_1$ abutting against a pump driving cam 79, a second arm $\mathbf{80}_2$ connected to the fuel pump 64*a*, and a boss portion $\mathbf{80}_3$ swingably supported on an intake rocker arm shaft 72. Thus, it is unnecessary to provide the supporting portions $\mathbf{8}_1$, $\mathbf{8}_1$ for supporting the pump driving members 80 on the cylinder head 8, and it is also unnecessary to be concerned about interference between the supporting portions $\mathbf{8}_1$, $\mathbf{8}_1$ and the valve springs 81, 81, leading to an increased degree of freedom in layout of the intake valves 74, 74.

A third embodiment of the present invention will now be described with reference to FIG. 8.

The third embodiment improves on the support of the intake and exhaust rocker arms 73 and 76 of the first embodiment. More specifically, the intake and exhaust rocker arms 73 and 76 in the first embodiment are axially positioned in such a manner that they are urged against the end face of the holder $\mathbf{8}_2$ integrally with the cylinder head 8 by the coil springs 82, 82 fitted over the outer peripheries of the intake and exhaust rocker arm shafts 72 and 75 (see FIG. 5). In this case, the coil spring 82 may be largely deformed by a load due to inertia in addition to gravity, particularly, because the intake rocker arm 73 is increased in size and weight in order to drive the two intake valves 74, 74, and the intake rocker arm shaft 72 is vertically disposed.

Figure 8:
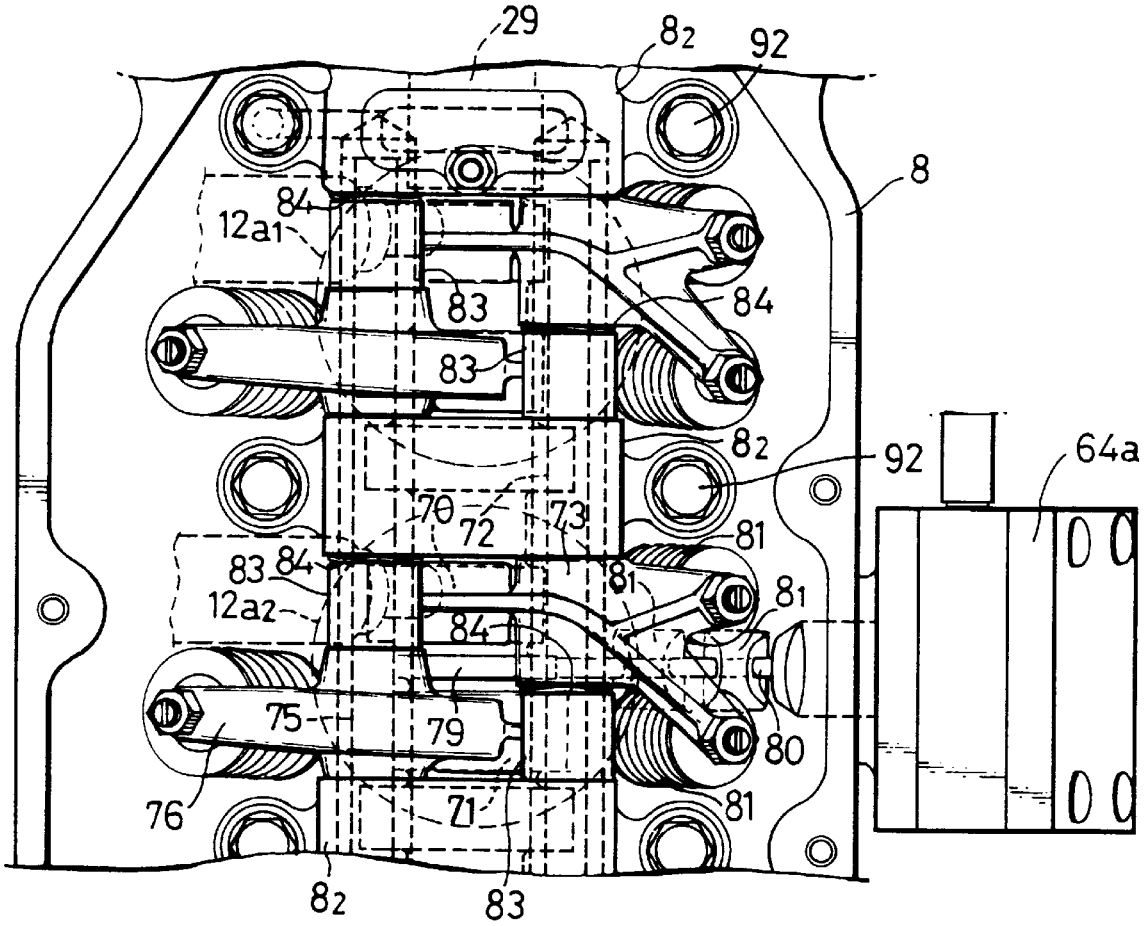
FIG. 8 is a view similar to FIG. 5, but illustrating a third embodiment of the present invention.

Therefore, in the third embodiment shown in FIG. 8, collars 83, 83 are substituted for the coil springs 82, 82 and are fitted over the outer peripheries of the intake and exhaust rocker arm shafts 72 and 75. Wave washers 84, 84 are disposed between end faces of the collars 83, 83 and the end face of the holder $\mathbf{8}_2$ whereby the intake and exhaust rocker arms 73 and 76 are positioned at the end face of the holder $\mathbf{8}_2$ by resilient forces of the wave washers 84, 84. The wave washers 84, 84 are deformed in a smaller amount than that of the coil springs 82, 82 and hence, it is possible to reduce the amount of axial movement of the intake and exhaust rocker arms 73 and 76 and to permit a smooth swinging movement of them.

Although the embodiments of the present invention have been described in detail, it will be understood that the present invention is not limited to the above-described embodiments, and various modifications in design may be made without departing from the spirit and scope of the invention defined in the claims.

For example, although the inline 4-cylinder engine of the outboard engine system has been illustrated in the embodiments, the present invention is applicable to an engine other than the engine of the outboard engine system O, and also to a V-type engine and a multi-cylinder engine other than a 4-cylinder engine. Further, the present invention is also applicable to an engine including a crankshaft disposed horizontally or obliquely. Additionally, the number of the cylinders $\mathbf{12}a_1$, $\mathbf{12}a_2$, $\mathbf{12}b_1$, $\mathbf{12}b_2$ constituting the cylinder groups 12*a*, 12*b* is not limited to that in the embodiments, and the number of the fuel pumps 64*a* and 64*b* is also not limited to that in the embodiments.

What is claimed is:

1. A fuel supply system for a multi-cylinder engine for supplying fuel from at least one fuel pump to a carburetor mounted for each of a plurality of cylinders, wherein said plurality of cylinders are divided into a plurality of cylinder groups along a direction of an array of the cylinders, and one fuel pump is provided for each of said cylinder groups within a predetermined arrangement of the cylinders of respective cylinder groups.

2. A fuel supply system for a multi-cylinder engine comprising:

fuel pumps for supplying fuel to a carburetor mounted for each of a plurality of cylinders, wherein said plurality of cylinders are divided into a plurality of cylinder groups, and said fuel pumps are mounted in correspondence to each of the cylinder groups; and a camshaft provided in common for the plurality of cylinders, said camshaft having a plurality of pump driving cams provided thereon for driving said fuel pumps.

3. A fuel supply system for a multi-cylinder engine for supplying fuel from at least one fuel pump driven by a camshaft to a carburetor mounted for each of a plurality of cylinders, said fuel supply system comprising:

a pump driving member disposed between valve springs of two intake valves mounted to correspond to each of the cylinders, and said pump driving member connects said at least one fuel pump with a pump driving cam provided on the camshaft, wherein said pump driving member is swingably supported on an intake rocker arm shaft on which an intake rocker arm for driving said intake valves is pivotally supported.

4. A fuel supply system for a multi-cylinder engine for supplying fuel from at least one fuel pump driven by a camshaft to a carburetor mounted for each of a plurality of cylinders, said fuel supply system comprising:

a pump driving member disposed between valve springs of two intake valves mounted to correspond to each of the cylinders, and said pump driving member connects said at least one fuel pump with a pump driving cam provided on the camshaft; and a pair of supporting portions projected from a cylinder head at opposite sides of a straight line connecting said two intake valves, and said pump driving member is slidably supported on said supporting portions.

5. A fuel supply for a multi-cylinder engine for supplying fuel from at least one fuel pump driven by a camshaft to a carburetor mounted for each of a plurality of cylinders, said engine including two intake valves mounted to correspond to each of the cylinders, at least one intake rocker arm associated with said two intake valves, and a rocker arm shaft provided commonly for the intake rocker arms of the cylinders, said fuel supply system comprising:

a pump driving member disposed between valve springs of said two intake valves and bisecting a line connecting said valve springs, and wherein said pump driving member connects said at least one fuel pump with a pump driving cam provided on the camshaft.

6. A fuel supply system according to claim 1 wherein two fuel pumps are provided.

7. A fuel supply system according to claim 1 wherein each fuel pump is mounted at a location slightly lower than a carburetor for a lowest mounted cylinder of a cylinder group.

8. A fuel supply system according to claim 5 further comprising intake and exhaust rocker arms axially positioned to urge against an end face of a holder, integral with a cylinder head, by resilient means which is fitted over outer peripheries of intake and exhaust rocker arm shafts.

9. A fuel supply system according to claim 8, wherein said resilient means are coil springs.

10. A fuel supply system according to claim 8 wherein said resilient means are collars and wave washers, said wave washers disposed between end faces of the collars and said end face of said holder.

* * * * *